US010703533B2

(12) United States Patent
Ramsey et al.

(10) Patent No.: US 10,703,533 B2
(45) Date of Patent: Jul. 7, 2020

(54) CAN WITH END VENTING FEATURE

(71) Applicant: CROWN PACKAGING TECHNOLOGY, INC., Alsip, IL (US)

(72) Inventors: Christopher Paul Ramsey, Oxfordshire (GB); Thomas Alexander Groves, Buckinghamshire (GB); Anthony Charles Franco, Worth, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 96 days.

(21) Appl. No.: 16/060,713

(22) PCT Filed: Dec. 8, 2016

(86) PCT No.: PCT/EP2016/080252
§ 371 (c)(1),
(2) Date: Jun. 8, 2018

(87) PCT Pub. No.: WO2017/097903
PCT Pub. Date: Jun. 15, 2017

(65) Prior Publication Data

US 2018/0362209 A1 Dec. 20, 2018

(30) Foreign Application Priority Data

Dec. 9, 2015 (GB) ..... 1521700.3

(51) Int. Cl.
*B65D 17/00* (2006.01)
*B65D 17/28* (2006.01)

(52) U.S. Cl.
CPC ..... *B65D 17/404* (2018.01); *B65D 17/4012* (2018.01); *B65D 2517/0014* (2013.01);
(Continued)

(58) Field of Classification Search
CPC ..... B65D 17/404; B65D 17/4012; B65D 2517/0014; B65D 2517/0062; B65D 2517/0082; B65D 2517/0092
(Continued)

(56) References Cited

U.S. PATENT DOCUMENTS 3,662,916 A 5/1972 Holk, Jr.
3,967,752 A 7/1976 Cudzik
(Continued)

FOREIGN PATENT DOCUMENTS

CN 1118150 A 3/1996
CN 102951343 A 3/2013
(Continued)

*Primary Examiner* — King M Chu
(74) *Attorney, Agent, or Firm* — BakerHostetler

(57) ABSTRACT

A metal end for seaming onto a metal container body. The end comprises an outer curl, a centre panel within the outer curl, and a tab having a longitudinal axis (A). The end further comprises a rivet securing the tab to the centre panel, and a score in the centre panel having two spaced apart ends which define a hinge therebetween, the hinge lying on one side of said longitudinal axis (A), such that operation of the tab fractures the score and causes the region of the centre panel within the score to pivot about the hinge and provide an aperture in the centre panel. The score extends into a region of the centre panel that is behind a centre line (B) running through the centre of the rivet and perpendicular to said longitudinal axis (A), and on the other side of the longitudinal axis (A) from the hinge.

14 Claims, 5 Drawing Sheets

(52) U.S. Cl.
CPC ..... *B65D 2517/0062* (2013.01); *B65D 2517/0082* (2013.01); *B65D 2517/0092* (2013.01)

(58) Field of Classification Search
USPC ..... 220/269
See application file for complete search history.

(56) References Cited

U.S. PATENT DOCUMENTS

| | | | | | |
|---|---|---|---|---|---|
| 4,062,471 | A * | 12/1977 | Perry | B21D 51/383 | 220/269 |
| 4,723,684 | A * | 2/1988 | Lambert | B65D 17/401 | 220/268 |
| 8,950,619 | B2 * | 2/2015 | Bork | B64D 11/0641 | 220/269 |
| 9,561,888 | B2 | 2/2017 | Nesling et al. | | |
| 9,815,590 | B2 | 11/2017 | Keane | | |
| 2007/0215621 | A1 * | 9/2007 | Shinguryo | B65D 17/404 | 220/269 |
| 2013/0037542 | A1 * | 2/2013 | Crothers | B65D 17/4012 | 220/269 |
| 2015/0329238 | A1 | 11/2015 | Chasteen et al. | | |

FOREIGN PATENT DOCUMENTS

| | | | |
|---|---|---|---|
| EP | 1884476 | | 2/2008 |
| EP | 3009370 | A1 | 4/2016 |
| EP | 3157826 | | 4/2017 |
| JP | 2015-000734 | | 1/2015 |
| MX | PA02006147 | A | 1/2003 |
| WO | WO 2014/200098 | A1 | 12/2014 |

* cited by examiner

CAN WITH END VENTING FEATURE

CROSS-REFERENCE TO RELATED APPLICATIONS

This application is the National Stage of International Patent Application No. PCT/EP2016/080252, filed Dec. 8, 2016, which claims priority from Great Britain Patent Application No. 1521700.3, filed Dec. 9, 2015, the disclosures of each are incorporated herein by reference in their entireties for any and all purposes.

TECHNICAL FIELD

The present invention relates to a can end with a venting feature to increase flow rate. The invention also relates to cans provided with such can ends.

BACKGROUND

The majority of metal beverage cans in the marketplace today are two-piece cans, comprising a one-piece can body with a can end seamed to the open end.

Furthermore, the most common type of can end is that known as the "stay on tab" end. A stay on tab end comprises a tab that is levered up by the consumer's finger to cause a fracture along a score line defining the aperture. Once opened, the tab is pressed back against the end and remains attached to the can end. A can end of this type has been produced for some years by Crown Holdings Inc under the brand name SuperEnd®.

For some applications it is desirable to increase the liquid flow rate through the aperture of a can end. For example, in restaurants and cafes it may be helpful to quickly empty the contents of a can into a drinking glass. Consumers drinking directly from the can may also find this beneficial. Can ends that avoid so-called "glugging" during pouring can also be desirable.

Crown Holdings Inc addressed these problem with a can end known by the brand name 360 End®. The 360 End is an end suitable for closing a can body with an opening having an inside diameter of around 52 mm (otherwise known as a 202 diameter neck where 202 nominally represents 2 2/16" over the seam when the can has been seamed) and allows almost the entire centre panel of the end to be removed when opened. Crown has also produced an end known by the brand name Global Vent™ and which features a dual aperture opening mechanism to facilitate a smoother pour from the beverage can, enhancing the consumer experience. Consumers simply open the beverage can as usual, turn the tab to align it over a button-shaped depression to the right of the main opening, and then press down to activate the second aperture. The second aperture provides a venting hole allowing air to flow into the can as the product flows out of the main aperture. Whilst the Global Vent™ end provides extremely good performance it requires an additional opening step as compared with conventional ends.

In addition to these Crown Holdings Inc can ends, other manufacturers have marketed or attempted to market can ends that claim to facilitate an increased flow rate and/or anti-glugging.

Whilst at first sight it might seem obvious to increase the size and/or shape of the aperture to increase flow rate and avoid glugging, this is far from trivial. Any practical design must maintain both the ease of opening of conventional ends and maintain the level of pressure performance. Additionally, in a very competitive field, any new can end designs should not add significantly to production costs.

US20150329238 is concerned with beverage can ends with a supplemental venting feature.

SUMMARY OF THE INVENTION

According to a first aspect of the present invention there is provided a metal end for seaming onto a metal container body. The end comprises an outer curl, a centre panel within the outer curl, and a tab having a longitudinal axis (A). The end further comprises a rivet securing the tab to the centre panel, and a score in the centre panel having two spaced apart ends which define a hinge therebetween, the hinge lying on one side of said longitudinal axis (A), such that operation of the tab fractures the score and causes the region of the centre panel within the score to pivot about the hinge and provide an aperture in the centre panel. The score extends into a region of the centre panel that is behind a centre line (B) running through the centre of the rivet and perpendicular to said longitudinal axis (A), and on the other side of the longitudinal axis (A) from the hinge.

The tab may be in substantially the same rotational orientation, with respect to a rotational axis provided by the rivet, that it adopts when the tab is fully raised and the aperture opened.

The end may comprise a chuck wall between the curl and the centre panel, and, optionally, a countersink between the chuck wall and the centre panel. Alternatively, no countersink may be present between the centre panel and the chuck wall.

At least 0.5%, and preferably at least 1%, of the region of the centre panel within the score may be behind a centre line (B) running through the centre of the rivet and perpendicular to said longitudinal axis (A), and on the other side of the longitudinal axis (A) from the hinge.

The score may be at least 0.5 mm, and preferably at least 1 mm, behind a centre line (B) running through the centre of the rivet and perpendicular to said longitudinal axis (A), and on the other side of the longitudinal axis (A) from the hinge.

The venting radius on the score, behind a centre line (B) running through the centre of the rivet and perpendicular to said longitudinal axis (A), and on the other side of the longitudinal axis (A) from the hinge, may be in the range from 2 mm to 6 mm, preferably from 2.5 mm to 5 mm.

The end may be a 47 mm end or smaller, optionally 43 mm or less.

The end pouring aperture may have a length of 14 mm or less and a flowrate of greater than 30 ml/sec.

The end may have a substantially flat panel with local features to absorb excess material generated by the scoring and rivet forming but without a countersink groove that conventionally acts to stiffen the end panel.

According to a second aspect of the present invention there is provided a container comprising a metal container body and a metal end according to the above first aspect, the end being seamed to an opening of the metal container body in order to close the metal container body.

Although the score in the centre panel of the can has been described with reference to the longitudinal axis (A) of the tab, other axes can of course be defined for this purpose. Some of these alternative definitions are set out in the following exemplary embodiments.

In an exemplary embodiment of the present invention there is a metal end for seaming onto a metal container body. The end is formed from a shell having a mirror symmetry axis. The end comprises an outer curl, a centre panel within the outer curl, and a tab. The end further comprises a rivet securing the tab to the centre panel, the rivet being located on the symmetry axis, and a score in the centre panel having two spaced apart ends which define a hinge therebetween, the hinge lying on one side of said symmetry axis, such that operation of the tab fractures the score and causes the region of the centre panel within the score to pivot about the hinge and provide an aperture in the centre panel. The score extends into a region of the centre panel that is behind a centre line (B) running through the centre of the rivet and perpendicular to said symmetry axis, and on the other side of the symmetry axis from the hinge.

In another exemplary embodiment of the present invention there is a metal end for seaming onto a metal container body. The end comprises an outer curl, a centre panel within the outer curl, and a tab. The end further comprises a rivet securing the tab to the centre panel, the rivet being offset from the midpoint of the centre panel, and a score in the centre panel having two spaced apart ends which define a hinge therebetween, the hinge lying on one side of a longitudinal axis defined between the rivet and the midpoint of the centre panel, such that operation of the tab fractures the score and causes the region of the centre panel within the score to pivot about the hinge and provide an aperture in the centre panel. The score extends into a region of the centre panel that is behind a centre line (B) running through the centre of the rivet and perpendicular to said longitudinal axis, and on the other side of the longitudinal axis from the hinge.

In another exemplary embodiment of the present invention there is a metal end for seaming onto a metal container body. The end comprises an outer curl, a centre panel within the outer curl, a countersink with a mirror symmetry axis and a tab. The end further comprises a rivet securing the tab to the centre panel, the rivet being located on the symmetry axis, and a score in the centre panel having two spaced apart ends which define a hinge therebetween, the hinge lying on one side of the symmetry axis, such that operation of the tab fractures the score and causes the region of the centre panel within the score to pivot about the hinge and provide an aperture in the centre panel. The score extends into a region of the centre panel that is behind a centre line (B) running through the centre of the rivet and perpendicular to said symmetry axis, and on the other side of the symmetry axis from the hinge.

In another exemplary embodiment of the present invention there is a metal end for seaming onto a metal container body. The end comprises an outer curl, a centre panel within the outer curl, and a tab. The end further comprises a rivet securing the tab to the centre panel, and a score in the centre panel having two spaced apart ends which define a hinge therebetween, the hinge lying on one side of a longitudinal axis defined between the rivet and a point on the score on the opposite side from the rivet, the point being chosen such that the longitudinal axis intersects the score at right angles, such that operation of the tab fractures the score and causes the region of the centre panel within the score to pivot about the hinge and provide an aperture in the centre panel. The score extends into a region of the centre panel that is behind a centre line (B) running through the centre of the rivet and perpendicular to said longitudinal axis, and on the other side of the longitudinal axis from the hinge.

DETAILED DESCRIPTION

Figure 1:
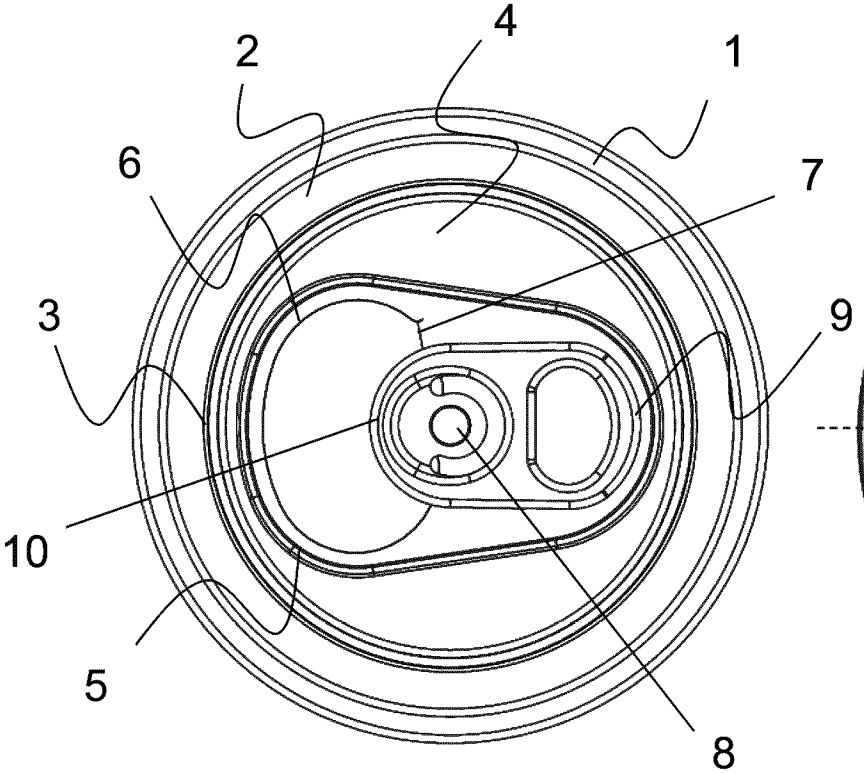

FIG. 1 illustrates in top plan view a known stay-on tab end (unseamed) as produced by Crown Holdings Inc and marketed under the brand name SuperEnd®. The end is formed by first pressing a disk of material, typically aluminium, using a press referred to as a "shell press". The process creates various features in the disk including an outer curl 1, a chuck wall 2 radially inward of the curl 1, an outwardly concave anti-peaking bead ("countersink") 3 radially inward of the chuck wall 2, and a central panel 4. The shell press also forms a continuous reinforcing bead 5 in the centre panel. Other features may also be formed in the shell press but are not described here. The end when it comes out of the shell press is referred to as a "shell".

Finished shells are fed into a press referred to as a "conversion press". The conversion press impresses a score 6 into the centre panel. The score 6 has a residual depth of approximately 0.091 mm along most of its length, but has a break 7 at one side. The score 6 is discontinuous with a break in the region to the left of the rivet. An upwardly projecting rivet 8 is formed in the middle of the centre panel 4 and a tab 9 is fixed to the rivet.

The finished end is seemed onto a filled can body. The product is opened by the consumer inserting his or her finger under the rightmost end of the tab, as viewed in FIG. 1, and levering the tab upwards. This action causes the nose of the tab, identified in the Figure by reference numeral 10, to be forced down against an area of the centre panel within the score 6, initially breaking the score at a point radially inward of the nose. The score residual is increased for a portion of the score profile, such that that the resistance to fracturing is greater. This shallow region of the score is referred to as the "arrestor" and typically has two depths; a mid-depth region from approximately 2.5 to 5 mm away from the rivet, and a full-depth region from approximately 5 to 7.5 mm away from the rivet. The mid-depth region has a score residual of around 0.132 mm and the full-depth region has a score residual of around 0.150 mm.

The initial fracture causes the interior of the can to vent and the fracture runs quickly around the score line up to the arrester. This creates a sufficiently large aperture to vent the headspace gas safely. Thus, by the time the user fully fractures the arrestor, the can is substantially fully vented. Continued levering of the tab, pressing the tab nose further into the can, causes the fracture to run clockwise around the score until it reaches the end, and eventually causes the panel within the score to bend around the break 7 which acts as a hinge, thus opening the aperture and allowing the contents to be poured out.

Figure 2:
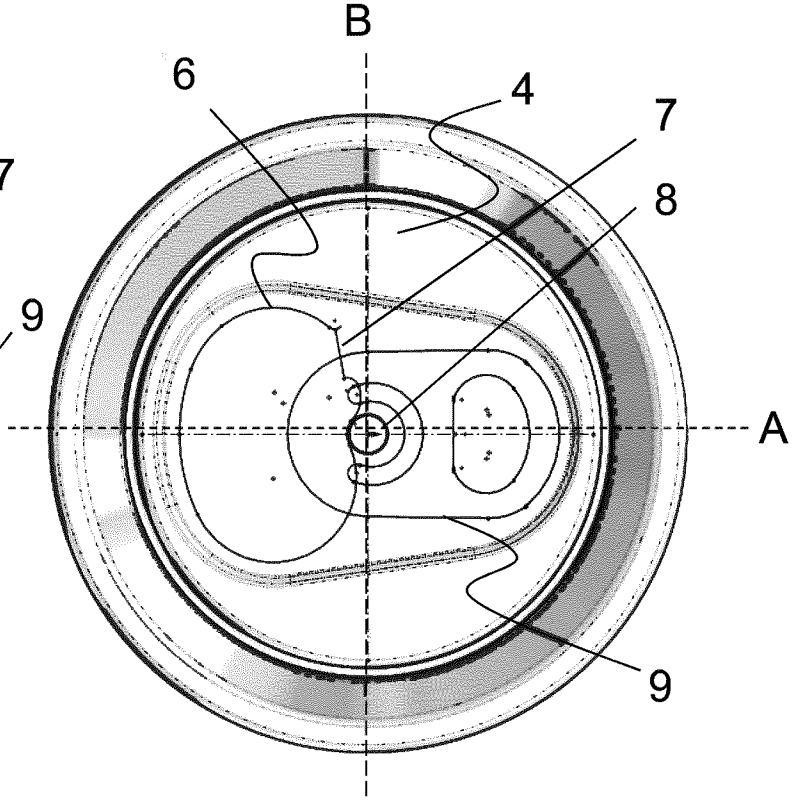
FIGS. 1 and 2 illustrate schematically a known, unseamed beverage can end.

FIG. 2 is a schematic illustration of the end of FIG. 1 highlighting the periphery of the tab 9 and the score line 6, as well as the rivet 8. FIG. 2 shows a broken line A indicating a longitudinal axis (or centre line) of the tab 9. The broken line ("centre line") B is perpendicular to the longitudinal axis A, and passes through the centre of the rivet 8. It will be clear from FIG. 2 that the score 6 does not extend beyond or behind the rivet 8, on that side of the rivet opposite the hinge 7, to any significant extent. In other words, the score 6 does not extend into the sector below the longitudinal axis A and to the right of the centre line B as shown in the Figure.

Figure 3:
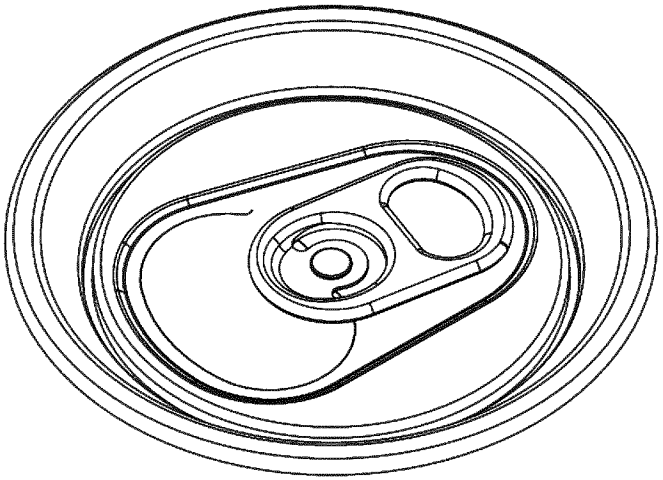
FIG. 3 is a perspective view of the unseamed can end of FIGS. 1 and 2.

FIG. 3 is a perspective view of the known can end of FIGS. 1 and 2.

Figure 5:
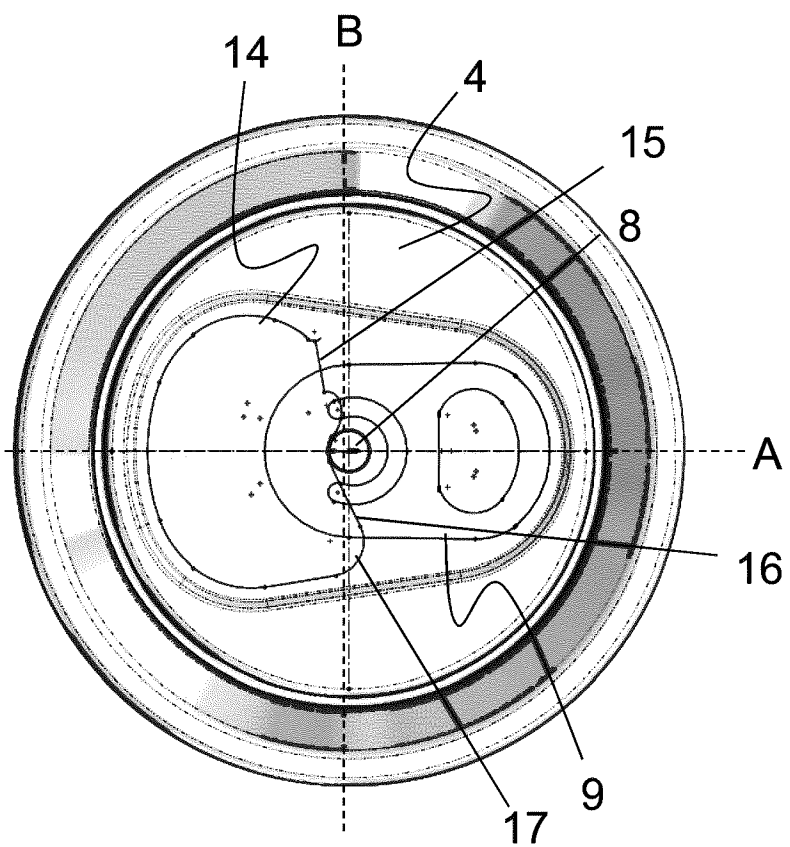
FIGS. 4 and 5 illustrate schematically an unseamed can end according to a first embodiment of the invention.
Figure 4:
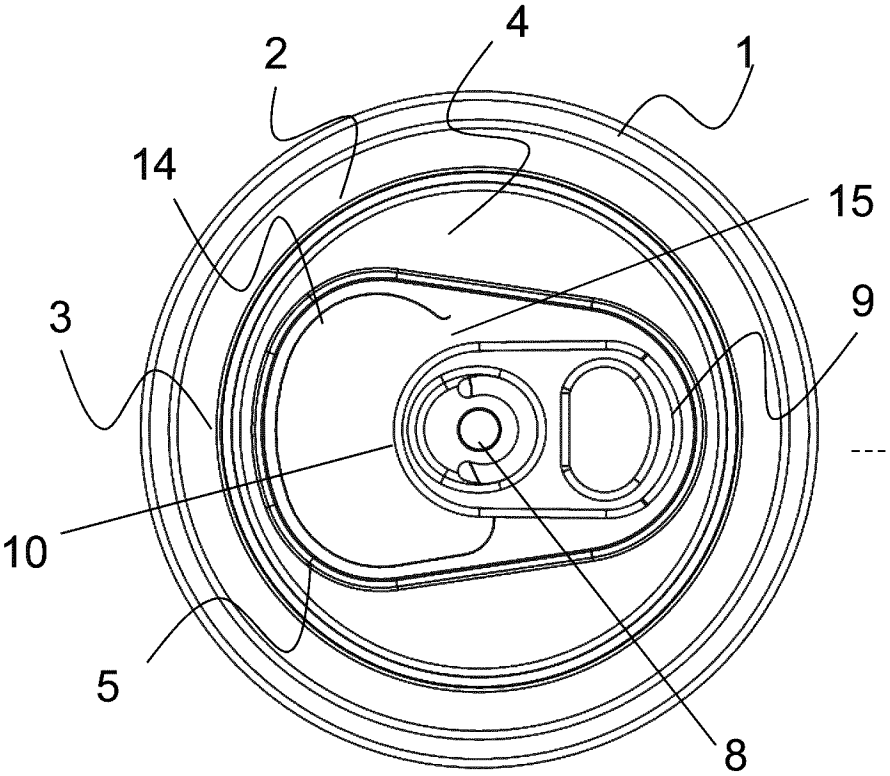

FIGS. 4 and 5 illustrate a can end configuration which may offer an improved flow rate. Features of the end common to the end of FIG. 1 are shown with like reference numerals. The relevant change relates to the score 14 which now runs into the section of the centre panel 4 to the right of the rivet centre line B, in that area below the longitudinal axis of the tab A. The percentage of the aperture panel defined by the score line which lies below the axis A and to the right of the centre line B is significant, e.g. more than 0.5% and preferably more than 1.0%. The score physically extends to the right of the centre line, preferably by a distance of at least 0.5 mm, and more preferably by a distance of at least 1.0 mm. Conventionally the score line would actually be around 1 mm to the left of the centre line. [It should be noted that moving the score to the right of the centre line would normally not be considered as a development option as it would be considered that this is likely to cause failure during opening as the score would not naturally propagate along such a path and the opening operation would fail during venting and/or subsequent aperture opening.]

The radius of score in the region of the venting feature has been found to be critical in order to achieve create the venting feature. This should be larger than 2 mm (preferably 2.5 mm) in order to give smooth score propagation, and smaller than 6 mm (preferably 5 mm) in order to create a discrete vent feature which lies above the main portion of the aperture.

Figure 6:
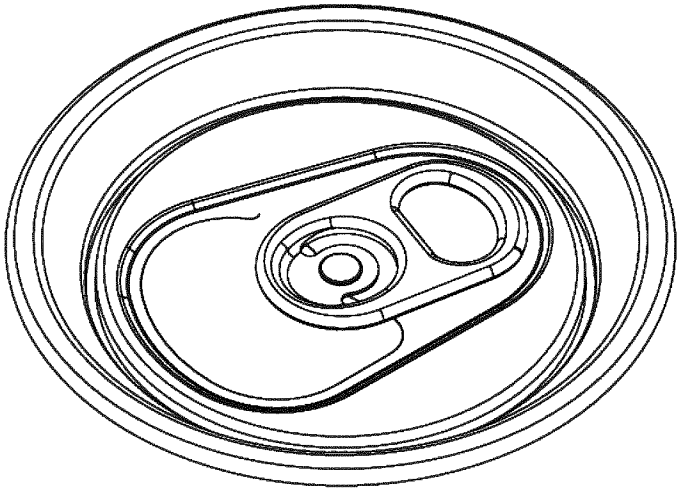
FIG. 6 is a perspective view of the unseamed can end of FIGS. 4 and 5.

It is noted that the only change to the end relates to the position and dimensions of the score 14. The end is otherwise conventional. As such, the only change required to the manufacturing line is a change to the tool that produces the score. This is a relatively small change to make. FIG. 6 is a perspective view of the can end of FIGS. 4 and 5

Tests have demonstrated that, for a 202 end, whilst the increase in aperture area resulting from the configuration illustrated in FIGS. 3 and 4 (in the case of a 202 end) may be around 10.4%, the flowrate through the aperture is increased by 36%. This is both surprising and significant. Conventionally the flowrate from an aperture is in proportion to the area. The inventors believe that the reason for the non-linear flow behaviour is due to the significantly increased aperture height which provides a portion of the aperture where air can readily ingress back into the can during pouring. This venting feature improves both the discharge flowrate and also the smoothness of the pour, with less tendency for the flow to glug during discharge. Indeed, the improvement in flow rate is so great that consumers will very likely be aware of the difference, meaning that cans incorporating the improved ends will be perceptively differentiated over cans with conventional ends.

The following performance checks have been conducted on the improved end:

- Pop and tear forces;
- Aged and seamed buckle pressure test;
- Safe venting at high internal pressure; and
- Opening after storage at high pressure when end is domed.

The results have confirmed that the performance of the improved end is not degraded in any of these areas.

A comparison of the ends of FIGS. 1 to 3 and 4 to 6 shows that, for the latter, the score around the vent feature has a tighter radius of curvature immediately following the arrestor flat. The arrestor flat is indicated in FIG. 5 by the reference numeral 16 with the following curved section indicated by reference numeral 17. By way of example, for a conventional 202 end, the radius of curvature of the score immediately following the arrestor may be in the region of 5 mm. For the improved end described here, the radius of curvature may be in the region of 4 mm or even 3 mm. As discussed above, the arrestor flat is a section of the score having a shallower depth that the remainder of the score. As such, the arrestor flat tends to offer greater resistance to fracture during initial venting. A further surprising advantage of the improved can end is that the tighter radius of curvature of the section 17 offers greater resistance to fracturing. Due to this increased resistance, in some embodiments the score residual in the arrestor 16 can be increased in order to make the score easier to open. In some cases the arrestor feature can be removed all together, i.e. the depth of the score 14 is substantially constant along its entire length. A benefit of removing the arrestor is that the production tooling is simpler to produce and maintain.

Table 1 below illustrates comparative dimensions and flow rates for a conventional 202 end, and for 202 ends having the improved design (4 mm and 3 mm radii of curvature). Percentage changes are also indicated where appropriate. Dimensions are all in millimetres, whilst the flow rate is given in units of mL/sec.

The discussion above assumes that for a given can end size, e.g. 202, we want to obtain an increased flow rate. However, the present invention also facilitates, for a given flow rate, a reduction of the can end diameter. As well as for use with cans of smaller volume, a reduced can end size is desirable for use with so-called "metal bottles". Such metal bottles have a shape resembling that of a glass bottles, having a longer and more slender neck than conventional metal cans. The narrower openings of metal bottles typically require end sizes of 45 mm or less. Manufacturers have faced challenges in manufacturing ends for metal bottles using designs based on convention stay-on tab type ends, particularly for end sizes of less than 45 mm.

Figure 7:
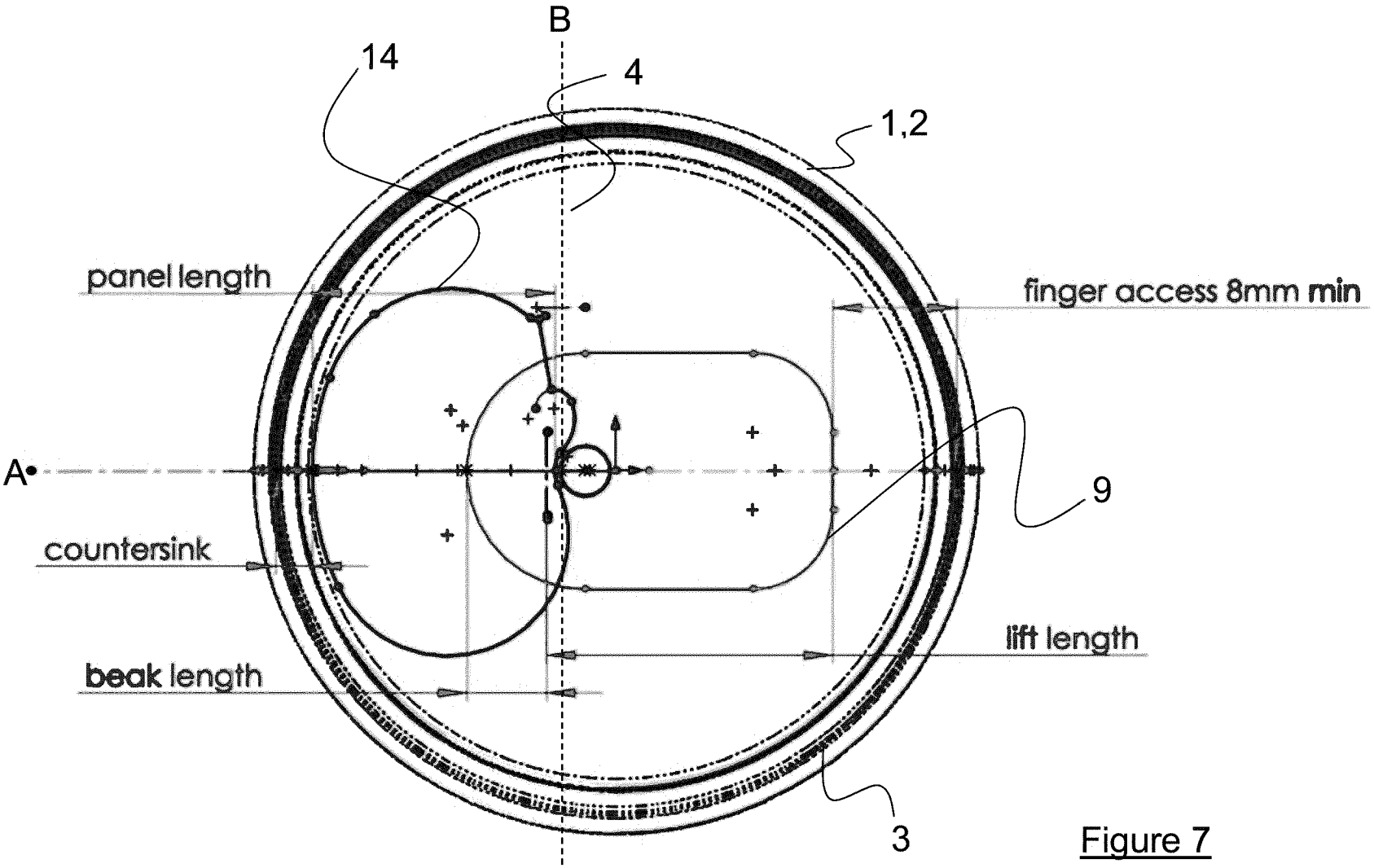
FIG. 7 illustrates certain key features of the known can end.

FIG. 7 illustrates schematically the centre panel of a 45 mm can end designed for use with a metal bottle. FIG. 7 points out a number of key design criteria including:

- Panel length—this is the length of the aperture panel that is opened in the end
- Finger access length—this is the length of the area into which a consumer can insert his or her finger to lift the tab.
- Lift length—this is the length of the tab between its radially outermost point and the opposed inner side of the rivet.
- Beak length—this is the length of the tab between the beak of the tab and the inner side of the rivet (where the tab is attached to the rivet platform forming a hinge)
- Countersink—this is the width of the countersink.

In order to allow for easy opening, the finger access length should be at least 8 mm. Reducing the length below this makes it difficult for some consumers to access the end of the tab. It is also important to maintain a suitable lift length to beak length ratio, and a suitable panel length to beak length ratio. Furthermore, the tab to panel contact point should be maintained when the tab is perpendicular to the centre panel upon opening, in order that the hinged position of the aperture panel is fully open allowing full product discharge.

The inventors have carried out "pouring" trials to shown that the improved flowrate end can use a panel length that is around 1.5 mm less than a conventional aperture panel length, where this length is the distance across the aperture as measured in the direction of axis B. This reduced aperture length in turn allows the use of a reduced beak length to effectively open the aperture. The beak length can be reduced by approximately 0.5 mm which allows for a reduced tab lift length to open the score effectively. The lift length is reduced by around 1.7 mm. The possible total reduction in panel diameter is therefore around (1.5 mm+1.7 mm) 3.2 mm.

The reduction in panel diameter gives rise to a further possibility. As a smaller panel is inherently stiffer, it becomes possible to omit the countersink. The countersink is typically provided to add stiffness to the end. Removal of the countersink saves at least a further 4 mm on the diameter of the end. The total saving for the same flow rate is therefore in the region of 7.2. For the same flow rate, a conventional 200 end (50 mm) may be replaced with a 47 mm end (with countersink) or a 43 mm end (without countersink). Changing from a 200 end to a 43 mm end achieves a dramatic metal saving.

Figure 8:
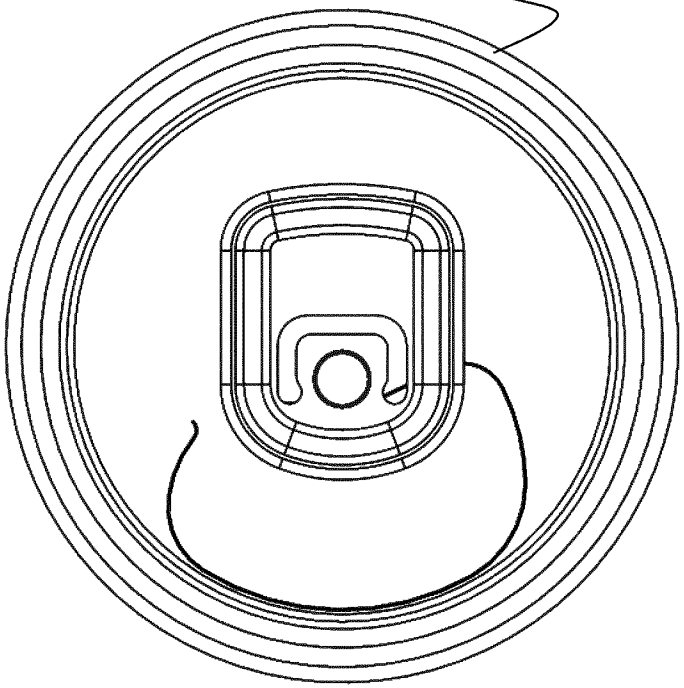
FIGS. 8 to 10 illustrate an end according to a second embodiment of the invention seamed to a container of the metal can type.
Figure 9:
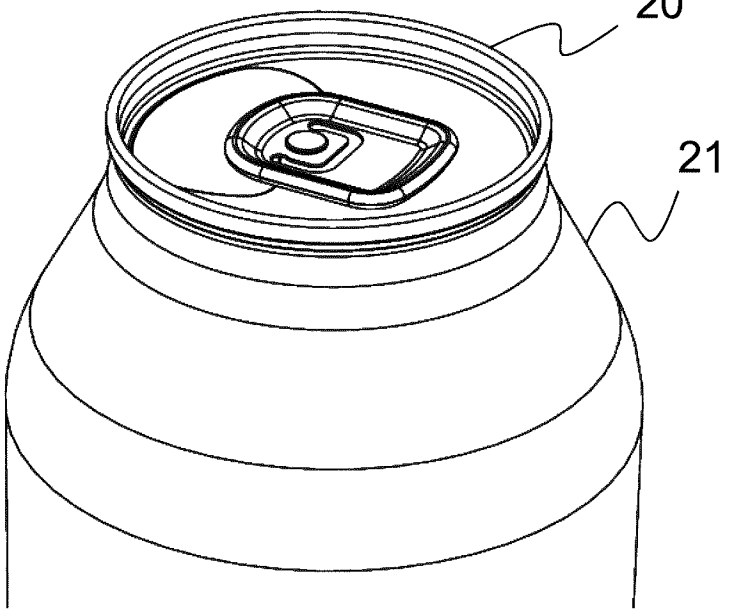
Figure 10:
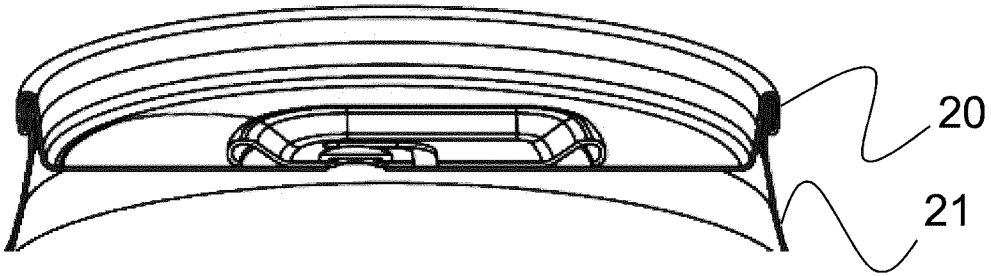

FIG. 8 illustrates an end 20 of the improved design suitable for closing a metal bottle. FIG. 9 shows the end seamed onto a metal can body 21, whilst FIG. 10 shows a perspective view of a vertical cross-section through the seamed end and can body of FIG. 9.

It is noted that embodiments of the invention are not only useful when it comes to enabling the production of metal bottles and achieving enhanced flow rates, they may also be used to reduce the failure rates of conventional can designs. The force applied to the underside of the region within the score is proportional to the area of that region. By reducing the area, the force is reduced, and the likelihood that the region within the score will detach during opening and "missile", is reduced. In other words, a smaller aperture size may reduce failure rates. In addition, or alternatively, embodiments may reduce stringent tooling requirements, particularly for the tool that forms the score as the tolerances allowed for the score may be increased.

It will be understood by the person of skill in the art that various modifications may be made to the above described embodiments without departing from the scope of the present invention.

TABLE 1

| | Conventional | Improved#1 | Improved#2 |
|---|---|---|---|
| Vent radius | 7.8 | 4 | 3 |
| Area | 318.52 | 348.8 | 351.64 |
| | | 9.5% | 10.4% |
| Flowrate | 36.38 | 45.16 | 49.49 |
| | | 24.1% | 36.0% |
| Vent to rivet | 1.07 | −0.82 | −1.31 |
| Vent to lower lip | 16.46 | 18.68 | 19.17 |
| | | 13.5% | 16.5% |

The invention claimed is:

1. A metal end for seaming onto a metal container body, the metal end comprising:

an outer curl;

a centre panel within the outer curl;

a reinforcing bead within the centre panel;

a tab having a longitudinal axis (A);

a rivet securing the tab to the centre panel, wherein the longitudinal axis (A) extends through a center of the rivet and a nose of the tab bisecting the reinforcing bead, the reinforcing bead extending continuously about the rivet; and a score in the centre panel having two spaced apart ends which define a hinge therebetween, the hinge lying on one side of said longitudinal axis (A) when the tab is in its normal unopened orientation, such that operation of the tab fractures the score and causes the region of the centre panel within the score to pivot about the hinge and provide an aperture in the centre panel, wherein the score extends into a region of the centre panel that is behind a centre line (B) running through the centre of the rivet and perpendicular to said longitudinal axis (A), and on the other side of the longitudinal axis (A) from the hinge.

2. A metal end according to claim 1 and comprising a chuck wall between the curl and the centre panel.

3. A metal end according to claim 2 and comprising a countersink between the chuck wall and the centre panel.

4. A metal end according to claim 2, wherein no countersink is present between the centre panel and the chuck wall.

5. A metal end according to claim 1, wherein the score is at least 0.5 mm behind a centre line (B) running through the centre of the rivet and perpendicular to said longitudinal axis (A), and on the other side of the longitudinal axis (A) from the hinge.

6. A metal end according to claim 5 wherein the score is at least 1 mm behind a centre line (B) running through the centre of the rivet and perpendicular to said longitudinal axis (A), and on the other side of the longitudinal axis (A) from the hinge.

7. A metal end according to claim 1, wherein the metal end is circular and has a diameter of 43 mm or less.

8. A metal end according to claim 1, wherein the aperture has a length of 14 mm or less and a flowrate of greater than 30 ml/sec.

9. A container comprising a metal container body and the metal end according to claim 1, the metal end being seamed to an opening of the metal container body in order to close the metal container body.

10. A metal end for seaming onto a metal container body, the end comprising:

an outer curl;

a centre panel within the outer curl;

a tab having a longitudinal axis (A);

a rivet securing the tab to the centre panel;

a score in the centre panel having two spaced apart ends which define a hinge therebetween, the hinge lying on one side of said longitudinal axis (A) when the tab is in its normal unopened orientation, such that operation of the tab fractures the score and causes the region of the centre panel within the score to pivot about the hinge and provide an aperture in the centre panel, wherein the score extends into a region of the centre panel that is behind a centre line (B) running through the centre of the rivet and perpendicular to said longitudinal axis (A), and on the other side of the longitudinal axis (A) from the hinge, and wherein at least 0.5% of the region of the centre panel within the score is behind a centre line (B) running through the centre of the rivet and perpendicular to said longitudinal axis (A), and on the other side of the longitudinal axis (A) from the hinge.

11. A metal end according to claim 10, wherein at least 1% of the region of the centre panel within the score is behind a centre line (B) running through the centre of the rivet and perpendicular to said longitudinal axis (A), and on the other side of the longitudinal axis (A) from the hinge.

12. A metal end for seaming onto a metal container body, the end comprising:

an outer curl;

a centre panel within the outer curl;

a tab having a longitudinal axis (A);

a rivet securing the tab to the centre panel;

a score in the centre panel having two spaced apart ends which define a hinge therebetween, the hinge lying on one side of said longitudinal axis (A) when the tab is in its normal unopened orientation, such that operation of the tab fractures the score and causes the region of the centre panel within the score to pivot about the hinge and provide an aperture in the centre panel, wherein the score extends into a region of the centre panel that is behind a centre line (B) running through the centre of the rivet and perpendicular to said longitudinal axis (A), and on the other side of the longitudinal axis (A) from the hinge, wherein a venting radius on the score, behind a centre line (B) running through the centre of the rivet and perpendicular to said longitudinal axis (A), and on the other side of the longitudinal axis (A) from the hinge, is in the range from 2 mm to 6 mm.

13. A metal end according to claim 12, wherein the venting radius on the score is in the range from 2.5 mm to 5 mm.

14. A metal end for seaming onto a metal container body, the end comprising:

an outer curl;

a centre panel within the outer curl;

a reinforcing bead within the centre panel;

a tab having a longitudinal axis (A);

a rivet securing the tab to the centre panel, wherein the longitudinal axis (A) extends through a center of the rivet and a nose of the tab bisecting the reinforcing bead, the reinforcing bead extending continuously about the rivet and a score in the centre panel having two spaced apart ends which define a hinge therebetween, the hinge lying on one side of said longitudinal axis (A) when the tab is in its normal unopened orientation, such that operation of the tab fractures the score and causes the region of the centre panel within the score to pivot about the hinge and provide an aperture in the centre panel, wherein the score extends into a region of the centre panel that is behind a centre line (B) running through the centre of the rivet and perpendicular to said longitudinal axis (A), and on the other side of the longitudinal axis (A) from the hinge, wherein the metal end is circular and has a diameter of 47 mm or smaller.

* * * * *